US007608033B2

(12) United States Patent
Wittmaier et al.

(10) Patent No.: US 7,608,033 B2
(45) Date of Patent: Oct. 27, 2009

(54) ROTARY CUTTING APPARATUS COMPRISING A PLACING SYSTEM FOR THE ORDERLY SORTING OF CUTS

(75) Inventors: Klaus Wittmaier, Vaihingen/Enz-Aurich (DE); Ralf-Hendrik Born, Vahingen/Enz (DE)

(73) Assignee: Schober GmbH Werkzeung- und Maschinenbau, Eberdingen (DE)

( * ) Notice: Subject to any disclaimer, the term of this patent is extended or adjusted under 35 U.S.C. 154(b) by 0 days.

(21) Appl. No.: 12/285,550

(22) Filed: Oct. 8, 2008

(65) Prior Publication Data

US 2009/0042704 A1 Feb. 12, 2009

Related U.S. Application Data

(63) Continuation of application No. 10/588,848, filed as application No. PCT/EP2005/001337 on Feb. 10, 2005, now abandoned.

(30) Foreign Application Priority Data

Feb. 12, 2004 (DE) ..... 10 2004 008 161

(51) Int. Cl.
*B31B 7/00* (2006.01)

(52) U.S. Cl. ..... 493/101; 493/83; 493/147; 493/313

(58) Field of Classification Search ..... 493/83, 493/101, 143, 144, 123, 313, 961, 147; 83/80, 83/106, 107; 414/265; 428/32.1, 32.6, 43, 428/44; 270/58.34, 58.23, 13
See application file for complete search history.

(56) References Cited

U.S. PATENT DOCUMENTS

| | | | | |
|---|---|---|---|---|
| 3,807,723 | A * | 4/1974 | Thomas | 270/58.23 |
| 3,881,717 | A * | 5/1975 | Dean | 270/58.23 |
| 3,920,236 | A * | 11/1975 | Kronsved | 270/58.23 |
| 4,331,327 | A * | 5/1982 | Felix | 271/9.13 |
| 4,593,893 | A * | 6/1986 | Suter | 270/52.12 |
| 5,235,883 | A * | 8/1993 | Jeske et al. | 83/80 |
| 6,646,280 | B1 * | 11/2003 | Schaede | 250/559.01 |

FOREIGN PATENT DOCUMENTS

| | | |
|---|---|---|
| DE | 101 56 664 | 6/2003 |
| EP | 0 510 324 | 10/1992 |
| EP | 0 730 934 | 9/1996 |
| EP | 0 878 277 | 11/1998 |
| FR | 2 792 301 | 10/2000 |

* cited by examiner

*Primary Examiner*—Sameh H. Tawfik
(74) *Attorney, Agent, or Firm*—Paul Vincent

(57) ABSTRACT

A device creates blanks with the aid of a rotary cutting apparatus. The device is characterized in that a placing system is mounted downstream of the cutting apparatus for orderly sorting of the blanks.

25 Claims, 2 Drawing Sheets

ROTARY CUTTING APPARATUS COMPRISING A PLACING SYSTEM FOR THE ORDERLY SORTING OF CUTS

This application is a continuation of Ser. No. 10/588,848 filed Aug. 9, 2006, now abandoned as the national stage of PCT/EP2005/001337 filed on Feb. 10, 2005 and also claims Paris Convention priority of DE 10 2004 008 161.1 filed on Feb. 12, 2004 the entire disclosures of which are hereby incorporated by reference.

BACKGROUND OF THE INVENTION

The invention concerns a device for producing blanks using a rotary cutting apparatus, wherein a placing system is disposed downstream of the cutting apparatus for defined sorting of the blanks.

Processing systems for producing card-like blanks from sheets are known in the art. A defined number of items are thereby printed on each sheet, in particular marked or e.g. numbered, as e.g. in the production of playing cards, numbered tickets or blanks with special imprints. These sheets are subsequently collected and stacked and the sheets are individually cut in a longitudinal and transverse direction in an associated appropriate machine. The consecutive rows are subsequently stacked and disposed on top of each other to produce a sorted stack 4. This process is mainly applied for blanks 1 having a rectangular shape and cornered edges.

Blanks with round corners 2 are also produced by printing sheets which, lying on top of each other, are subsequently punched out using lift punching devices. In a further working step, these blanks are then rearranged into sorted stacks 4 in an automatic sorting machine.

There are also conventional machines which provide endless printed paper or product webs instead of printed sheets, which are then guided through a rotary cutting apparatus. The blanks 1, 2 are then sequentially stacked in rows and are later rearranged into sorted stacks in a sorting machine in a separate working step.

For sheet processing, all associated blanks are advantageously provided on one sheet to be processed. The large number of required processing steps is disadvantageous. The processing of endless printed product webs is advantageous due to the high speed and the possibility to install such machines directly after a printing machine for inline processing. The blanks 1, 2 produced in this manner must disadvantageously be subsequently guided through sorting machines to obtain the required mixtures or sorted stacks 4.

It is the underlying purpose of the invention to produce a rotary processing system for cutting the product web 3, printed during inline or offline operation, in a rotary method, placing the cut blanks 1, 2 over a full surface, receiving and mixing them in a particular device in accordance with a predetermined order to obtain a sorted stack 4 after passage through the entire device.

Another object of this machine is to mix the blanks in accordance with a certain matrix.

Another object of the apparatus is to examine printed endless goods for printing errors and remove these goods in a directed manner or to detect and properly remove whole sections of faulty blanks in the product web. This is advantageously achieved with the machine or device 5 described below.

SUMMARY OF THE INVENTION

These objects are achieved in accordance with the invention with a device comprising the features of the independent claim.

The device 5 comprises a roller 6 onto which the printed product web 3 is disposed. A manual or automatic splice means 7 is advantageously disposed downstream of the machine 5. A side edge control 8 is disposed downstream thereof to exactly position the printed product web 3. A decurling means 9 is used to counteract bending of the product web to compensate for curvatures or bending stress produced by rolling the product web. The pulling station 10 pulls the printed product web 3 from the roller 6 with a predetermined tension. The required tension compensation is regulated or controlled via the compensation system 11 and a brake or drive system. The rotary cutting apparatus 13 consists of a formatted cutting cylinder 14 and a counter pressure cylinder 15. During passage of the printed product web 3 through the rotary cutting apparatus 13, a blank 1, 2 is cut out from the product web 3. A waste strip or waste grid may thereby be produced between the products 1, 2 in the printed product web 3.

DESCRIPTION OF THE PREFERRED EMBODIMENT

Figure 1:
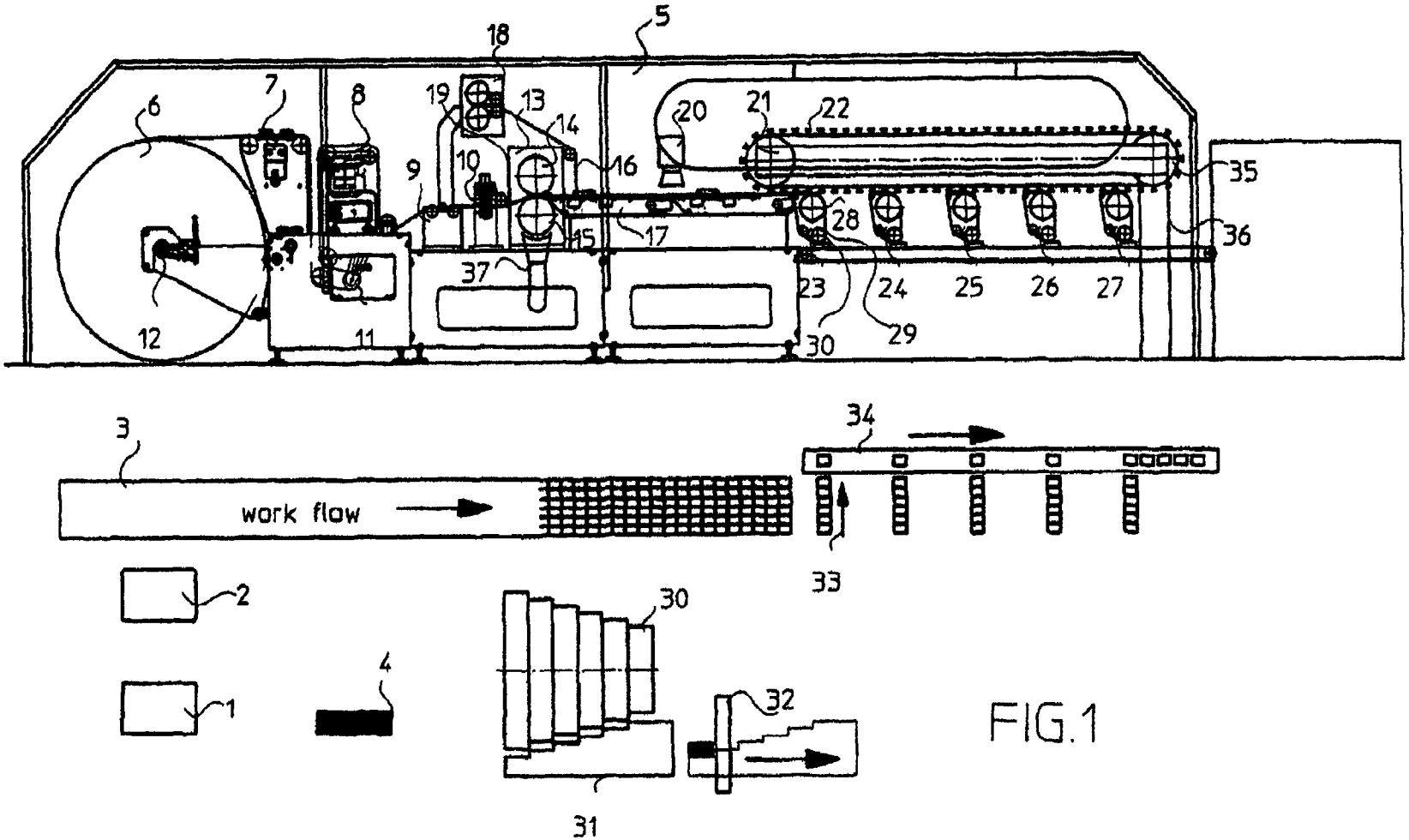
FIG. 1 illustrates the overall device in accordance with the invention.

In a preferred embodiment, the waste strip or waste grid 16 is guided out of the rotary cutting apparatus 13 together with the blank and taken over by the suction belt means 17. When the blanks 1, 2 have been safely received by the suction belt means 17, the waste strip or the waste grid is separated from the blanks 1, 2 through deflection and pulled into a chopper 18 where it is disintegrated and suctioned off. The blanks 1, 2 are then either spatially separated or, in one variant, disposed next to each other on the suction belt means 17 without intermediate waste. This suction belt means has a superior optical test device 20 to examine the blanks 1, 2 for completeness or faults. The suction belt means 17 also has a downstream suction cup wheel, disposed above the suction belt means, with subsequent suction cup belt. Individual suction cups 22 are disposed on this suction cup belt 21 in accordance with a predetermined matrix. The suction cups 22 have the same mutual separations as the blanks in the product web and move with the same speed as the suction belt means 17. The suction cups accept one or more rows of blanks using a control means, thereby suctioning and transferring the predetermined number of blanks 1, 2 to the stacking means 23 or any other downstream device.

A predetermined number of sequential blanks are repeatedly taken over by the sequential suction cups 22, transported and transferred to the next stacking means 24. Each stacking means 22-27 has a vacuum wheel 28 and vacuum belts 29. Each transferred blank 1, 2 is transferred to one track of the delivery wheel 30 using the vacuum wheel 28 and the vacuum belts 29. The delivery wheel 30 may be designed as vacuum drum or delivery star. The delivery wheel 30 must have different diameters in each track for placing the cards from each row at different levels in the delivery nest 31. When all blanks 1, 2 have been placed at different levels in the delivery nest 31 using the delivery wheel 30, the individual nest layers are pushed on top of each other by displacing the delivery nest 31 against the lateral stop 32, and the blanks are disposed on top of each other in a sorted stack 4. Sorting is achieved in that the blanks 1, 2 are printed one after the other in the printed product web in a predetermined order, and are then placed and stacked on top of each other at different levels using the delivery wheel 30 and the delivery nest 31.

The sorted stack 4 is pushed onto a transport belt 34 using a further pushing device 33, from where it is guided out of the machine to a conventional packaging system. Faulty blanks are transferred to the suctioning means 36 at the suction cup wheel 35 and transferred to a waste means. With particular advantage, different blank rows are taken over depending on the control of the suction cups 22 and each row is supplied to one of the stacking means 23 to 27, where they can be placed.

This permits arbitrary sorting. In one embodiment (not shown), each individual suction cup can moreover be controlled directly e.g. via a bus system. This permits individual different distribution of transferred blank 1, 2 rows to several stacking means 23 through 27.

Depending on the design, any number of suction cups 22 can advantageously be disposed and mounted at different separations on the suction cup belt 21.

Another advantage is that any number of stacking means 23 can be disposed one after another, as required.

Figure 2:
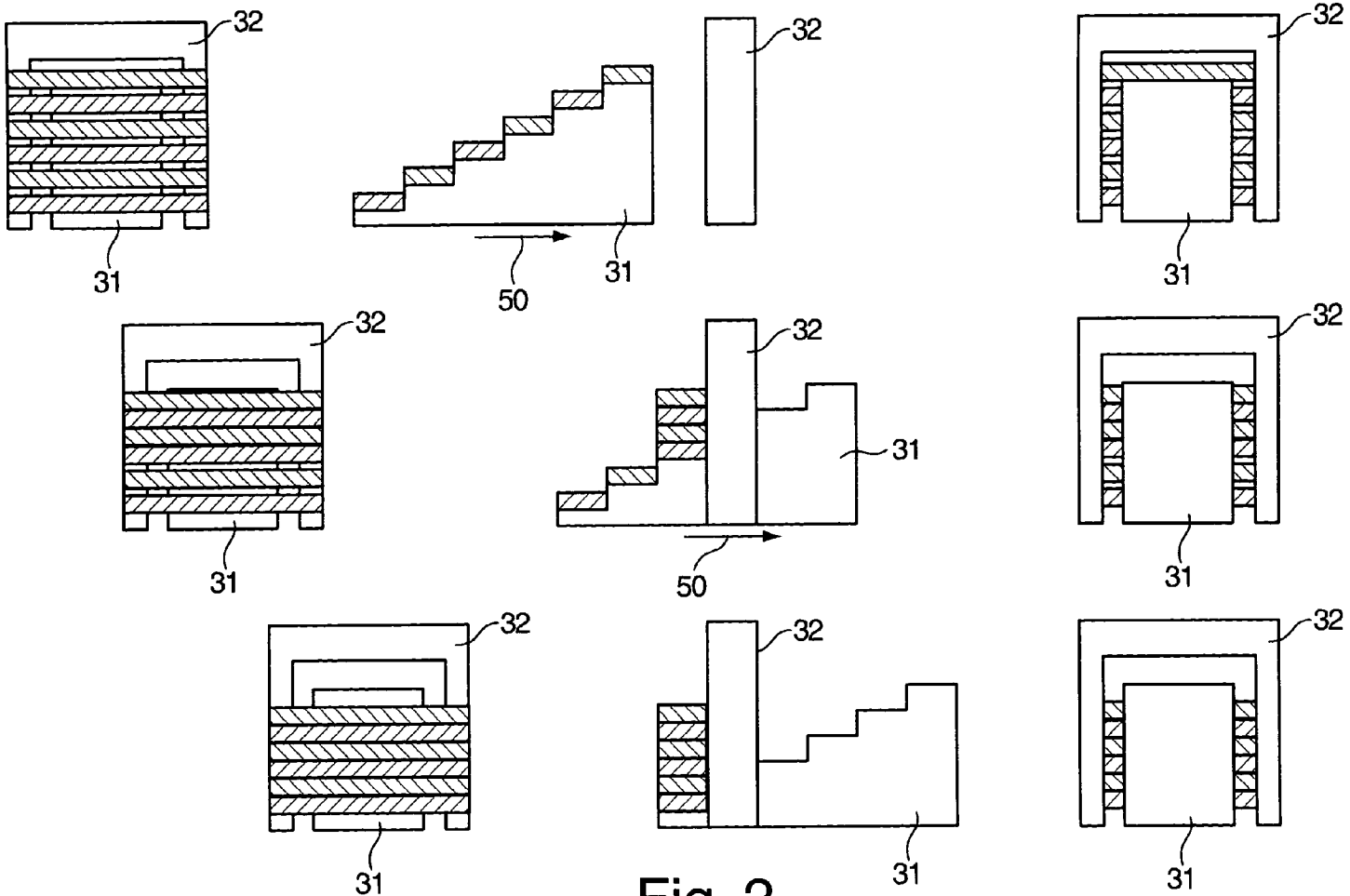
FIG. 2 illustrates the method of stacking and sorting in accordance with the invention.

FIG. 2 provides a more detailed description of the method of operation of the stacking and sorting device in accordance with the invention. The upper middle figure shows a side view of a first position of the delivery nest 31 relative to the stop 32. The delivery nest 31 is subsequently moved in the direction of arrow 50 to assume the position shown in the central middle figure of FIG. 2 and, through further movement of the delivery nest 31 in the direction of arrow 50, into the final position shown in the bottom middle figure of FIG. 2. The respective figures to the left and right of these middle figures in the upper, middle and lower portions of FIG. 2 are end views from the left and right hand side respectively in the respective positions indicated in the middle figures. The end views clearly illustrate the U-shaped structure of the stop 32 and the fact that the blanks, indicated by cross-hashed rectangles disposed on the step-like structures of delivery nest 31, protrude past the right and left sides of the delivery nest 31. As the delivery nest 31 is moved in the direction of arrow 50, the parallel side legs of U-shaped stop 32 successively abut against the blanks, thereby preventing the blanks from moving along with the delivery nest 31 in the direction of arrow 50, therefore resulting in a stacked deposit of the blanks on successive stairs of the delivery nest 31 as the delivery nest 31 is moved. In the first position of the delivery nest 31 relative to the stop 32 illustrated in the upper portion of FIG. 2, the blanks rest on individual steps of the stair-like structured delivery nest 31. As the delivery nest 31 is displaced towards the stationary stop 32 in the direction of arrow 50, it assumes an intermediate position shown in the middle portion of FIG. 2. In this position, the blanks which were originally deposited on the upper three stairs of the step-like structure of delivery nest 31 have been pushed through interaction with the stop 32, through successive stacking, onto the third lowest step of the delivery nest 31. Continued displacement of the delivery nest 31 relative to the stop 32 in the direction of arrow 50 leads to the configuration shown in the bottom portion of FIG. 2 in which the entire stack of blanks has been deposited on the lowermost step of the delivery nest 31.

The stacking and sorting system can be used to produce a sorted stack of blanks (cards), with differing individual cards being cut out of a sheet. Following stamping of the cards from the sheet, the individual cards can be combined into a completed set. Towards this end, the sheet can be split and cut into rows and columns in such a fashion that a plurality of cards are disposed in a row, with a plurality of rows, one behind the other. The cards disposed in one particular row can be deposited on an individual delivery nest 31 using the delivery wheel 30. The individual nests 31 have differing heights so that, following deposition, the cards can easily be pushed, one on top of the other.

LIST OF REFERENCE NUMERALS

1. cornered blanks
2. blanks with round corners
3. printed product web
4. sorted stack
5. machine
6. roller
7. splice means
8. side edge control
9. decurling means
10. pulling station
11. delivery system
12. brake and/or drive system
13. rotary cutting apparatus
14. cutting cylinder
15. counter pressure cylinder
16. waste strip/waste grid
17. suction belt means
18. chopper
19. pressure mark control
20. optical test device
21. suction cup belt
22. suction cups
23. stacking means
24. stacking means
25. stacking means
26. stacking means
27. stacking means
28. vacuum wheel
29. vacuum belts
30. delivery wheel (vacuum drum or delivery system)
31. delivery nest
32. stop
33. pushing device
34. transport belt
35. suction cup wheel
36. suctioning means
37. suction funnel
50. arrow

We claim:

1. A device for producing blanks from a product web, the device comprising:

rotary cutting means;

means, disposed downstream of said rotary cutting means, for sorting and stacking the blanks, said means for sorting and stacking comprising a delivery nest defining steps onto which the blanks are disposed at differing vertical and horizontal positions, wherein adjacent steps have a mutual vertical separation which is sufficiently large as to permit horizontal displacement of at least one blank from a higher lying step onto at least one blank disposed on an adjacent lower lying step;

means, disposed between said cutting means and said sorting and stacking means, for determining faulty blanks and for directly removing said faulty blanks prior to delivery to said sorting and stacking means; and waste means accepting the faulty blanks from said determining and removing means.

2. The device of claim 1, wherein a transfer system or a suction belt means is disposed downstream of said rotary cutting means.

3. The device of claim 2, wherein the blanks are separated from a waste strip or a waste grid at said suction belt means.

4. The device of claim 2, wherein an arbitrary number of blanks is disposed on said suction belt means, said determining and removing means comprising an optical test device disposed above said suction belt means for detecting printing faults or missing blanks.

5. The device of claim 2, further comprising a suction cup belt disposed downstream of said cutting means for receiving the blanks from said suction belt means.

6. The device of claim 5, wherein said suction cup belt comprises individual suction cups.

7. The device of claim 6, wherein said suction cups on said suction cup belt have same mutual separations as the blanks along the product web.

8. The device of claim 6, wherein said suction cups on said suction cup belt have different mutual separations than the blanks along the product web.

9. The device of claim 6, wherein said suction cups are disposed on said suction cup belt at variable separations.

10. The device of claim 6, wherein said sorting and stacking means comprises at least one stacking means disposed downstream of said suction belt means.

11. The device of claim 10, wherein said stacking means has a vacuum wheel, vacuum belts, and/or a delivery wheel.

12. The device of claim 11, wherein said delivery wheel is a vacuum drum or a delivery star.

13. The device of claim 11, wherein at least two delivery wheels are disposed next to each other on an axis, each delivery wheel having a different diameter.

14. The device of claim 11, wherein individual nest layers are pushed on top of each other to form a sorted stack by displacing said delivery nest against a lateral stop.

15. The device of claim 10, wherein, in dependence on a control of said suction cups, different blank rows are received and supplied in rows to one of said stacking means where the blanks are disposed and mixed a defined manner.

16. The device of claim 15, further comprising means for directly controlling each individual suction cup to permit distribution and mixing of individual blanks, received in rows, onto several stacking means.

17. The device of claim 15, wherein a plurality of stacking means are consecutively disposed.

18. The device of claim 1, wherein waste is directly separated from the blanks immediately downstream of said cutting means for removal over a surface of a cutting cylinder.

19. The device of claim 1, wherein a waste grid is guided over a surface of a counter pressure cylinder, downwards into a suction funnel, thereby separating waste from the blanks.

20. The device of claim 1, wherein said waste means comprise a chopper disposed downstream of said cutting means.

21. The device of claim 1, wherein the product web is printed in a predetermined transverse and longitudinal order.

22. The device of claim 1, wherein a pushing device pushes a sorted stack onto a transport belt.

23. The device of claim 1, wherein faulty blanks are transferred to a suctioning means at a suction cup wheel.

24. The device of claim 1, further comprising a print mark control, wherein said rotary cutting means cut out the blanks in exact register with the product web.

25. The device of claim 1, wherein the device is individually used as an offline machine or as an inline machine directly connected to other machines.

* * * * *